US009325071B2

(12) United States Patent
Fasenfest

(10) Patent No.: US 9,325,071 B2
(45) Date of Patent: Apr. 26, 2016

(54) PATCH ANTENNA

(71) Applicant: Kathleen Fasenfest, Union City, CA (US)

(72) Inventor: Kathleen Fasenfest, Union City, CA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 362 days.

(21) Appl. No.: 13/839,976

(22) Filed: Mar. 15, 2013

(65) Prior Publication Data

US 2014/0198014 A1 Jul. 17, 2014

Related U.S. Application Data

(60) Provisional application No. 61/752,914, filed on Jan. 15, 2013.

(51) Int. Cl.
*H01Q 9/04* (2006.01)
*H01Q 1/38* (2006.01)

(52) U.S. Cl.
CPC ..... *H01Q 9/045* (2013.01); *H01Q 9/0457* (2013.01); *H01Q 1/38* (2013.01); *H01Q 9/0428* (2013.01)

(58) Field of Classification Search
CPC .... H01Q 9/0428; H01Q 9/045; H01Q 9/0457
USPC ..... 343/906, 846
See application file for complete search history.

(56) References Cited

U.S. PATENT DOCUMENTS 4,973,972 A 11/1990 Huang
6,342,856 B1 1/2002 Nakano
6,345,856 B1 * 2/2002 Minai ..... B60N 2/01583 296/65.03
6,597,316 B2 7/2003 Rao et al.
6,700,539 B2 * 3/2004 Lim ..... H01Q 1/40 343/700 MS
7,209,080 B2 4/2007 Crouch et al.
2002/0036590 A1 * 3/2002 Itoh ..... H01Q 1/22 343/700 MS
2004/0004571 A1 * 1/2004 Adachi ..... H01Q 1/243 343/700 MS
2006/0007044 A1 * 1/2006 Crouch ..... H01Q 9/0435 343/700 MS
2006/0044191 A1 * 3/2006 Harihara ..... H01Q 1/2283 343/700 MS
2008/0042915 A1 * 2/2008 Schillmeier ..... H01Q 9/0414 343/745
2009/0046026 A1 * 2/2009 Nakano ..... H01Q 7/00 343/741
2009/0102723 A1 4/2009 Mateychuk et al.

(Continued)

OTHER PUBLICATIONS

International Search Report for International Application No. PCT/US2014/011745, mailed Jul. 11, 2014.*

(Continued)

*Primary Examiner* — Dameon E Levi
*Assistant Examiner* — Jennifer F Hu

(57) ABSTRACT

A patch antenna includes a dielectric substrate having a body that extends a thickness from a first side to a second side that is opposite the first side. The body of the substrate has a perimeter that is defined by at least one side wall that extends along the thickness of the substrate from the first side to the second side. The body of the substrate has a dielectric constant that is greater than air. The patch antenna also includes a radiating patch positioned on the first side of the body of the substrate, a ground plane positioned on the second side of the body of the substrate, and at least three feed probes electromagnetically coupled to the radiating patch such that the patch antenna is configured to generate a circularly polarized radiation pattern. The feed probes are positioned relative to the body of the substrate such that adjacent feed probes are spaced apart from each other along the body. The feed probes are configured to feed the radiating patch at at least three points with approximately equal power amplitude.

10 Claims, 8 Drawing Sheets

(56) References Cited

U.S. PATENT DOCUMENTS

| | | | | |
|---|---|---|---|---|
| 2009/0256773 | A1* | 10/2009 | Lindmark | H01Q 9/045 343/858 |
| 2014/0266963 | A1* | 9/2014 | Fasenfest | H01Q 9/045 343/857 |

OTHER PUBLICATIONS

Written Opinion of the Internation Searching Authority for International Application No. PCT/US2014/011745, mailed Jul. 15, 2015.*

* cited by examiner

PATCH ANTENNA

CROSS-REFERENCE TO RELATED APPLICATIONS

This application claims priority from provisional Application No. 61/752,914, filed Jan. 15, 2013, the disclosure of which is incorporated herein by reference.

BACKGROUND OF THE INVENTION

The subject matter disclosed herein relates generally to antennas, and more particularly to patch antennas.

Satellite navigation systems are well known for providing autonomous geo-spatial positioning. Satellite navigation systems typically include a constellation of satellites that orbit the earth. The constellation of satellites enables an electronic receiver to determine its location (e.g., longitude, latitude, and altitude) using time signals that are transmitted by radio frequency (RF) waves from the orbiting satellites. Satellite navigation systems with global coverage are commonly referred to as global navigation satellite systems (GNSSs). Although GNSSs have global coverage, different GNSSs may serve different regions. For example, different GNSSs may serve the United States, Europe, and Russia. Each different GNSS includes its own constellation of satellites that operates within its own frequency bands. In other words, different GNSSs that serve different regions may operate within different frequency bands.

Patch antennas are commonly used with electronic receivers for communicating with GNSS satellite constellations. A patch antenna is a type of antenna that typically includes a flat sheet, or patch, of metal that is mounted over a ground plane. Known patch antennas are not without disadvantages. For example, the frequency band of at least some known patch antennas may be too narrow to enable the patch antenna to communicate with one or more of the different GNSS satellite constellations. Specifically, at least some known patch antennas operate over a relatively narrow frequency band that does not overlap the frequency band of one or more of the different GNSS satellite constellations. The patch antenna therefore cannot communicate with such a GNSS satellite constellation because the patch antenna does not operate within the frequency band of the GNSS satellite constellation. For example, the frequency band of a patch antenna may overlap, or fall entirely within, the frequency band of a first GNSS satellite constellation that serves a region. But, the frequency band of the patch antenna may be too narrow to overlap the frequency band of a second GNSS satellite constellation that serves a different region. Accordingly, the patch antenna is capable of communicating with the first GNSS satellite constellation but is not capable of communicating with the second GNSS satellite constellation. The frequency band of at least some known patch antennas may be so narrow that the patch antenna is limited to communicating with a particular GNSS satellite constellation using only portion (i.e., a subband) of the frequency band of the GNSS satellite.

Another disadvantage of at least some known patch antennas is their size. For example, a single electronic receiver may be associated with a plurality of patch antennas that are grouped together in an array. But, there may be a limited amount of space for containing the array of patch antennas, which may limit the number of patch antennas that can be included within the array. For example, the width and/or a similar dimension (e.g., diameter and/or the like) of at least some known patch antennas limits the number of patch antennas that can be arranged side-by-side in the available space.

BRIEF DESCRIPTION OF THE INVENTION

In one embodiment, a patch antenna includes a dielectric substrate having a body that extends a thickness from a first side to a second side that is opposite the first side. The body of the substrate has a perimeter that is defined by at least one side wall that extends along the thickness of the substrate from the first side to the second side. The body of the substrate has a dielectric constant that is greater than the dielectric constant of air. The patch antenna also includes a radiating patch positioned on the first side of the body of the substrate, a ground plane positioned on the second side of the body of the substrate, and at least three feed probes electromagnetically coupled to the radiating patch such that the patch antenna is configured to generate a circularly polarized radiation pattern. The feed probes are positioned relative to the body of the substrate such that adjacent feed probes are spaced apart from each other along the body. The feed probes are configured to feed the radiating patch at at least three points with approximately equal power amplitude.

In another embodiment, a patch antenna includes a dielectric substrate having a body that extends a thickness from a first side to a second side that is opposite the first side. The body of the substrate has a perimeter that is defined by at least one side wall that extends along the thickness of the substrate from the first side to the second side. The body of the substrate has a dielectric constant that is greater than the dielectric constant of air. The patch antenna also includes a radiating patch positioned on the first side of the body of the substrate, a ground plane positioned on the second side of the body of the substrate, and four feed probes electromagnetically coupled to the radiating patch such that the patch antenna is configured to generate a circularly polarized radiation pattern. The feed probes are positioned relative to the body of the substrate such that adjacent feed probes are spaced apart from each other by approximately 90° along the body. The feed probes are configured to feed the radiating patch at four points with approximately equal power amplitude and a progressive 90° phase shift.

In another embodiment, an antenna system is provided. The antenna system includes a feed network configured to be operatively connected to a receiver and/or a transmitter, and a patch antenna operatively connected to the feed network for receiving radio frequency (RF) waves from the feed network and/or delivering RF waves to the feed network. The patch antenna includes a dielectric substrate having a body that extends a thickness from a first side to a second side that is opposite the first side. The body of the substrate has a dielectric constant that is greater than the dielectric constant of air. The patch antenna also includes a radiating patch positioned on the first side of the body of the substrate, a ground plane positioned on the second side of the body of the substrate, and four feed probes electromagnetically coupled to the radiating patch such that the patch antenna is configured to generate a circularly polarized radiation pattern. The feed probes are positioned relative to the body of the substrate such that adjacent feed probes are spaced apart from each other along the body. The feed probes are configured to feed the radiating patch at four points with approximately equal power amplitude.

DETAILED DESCRIPTION OF THE INVENTION

Figure 1:
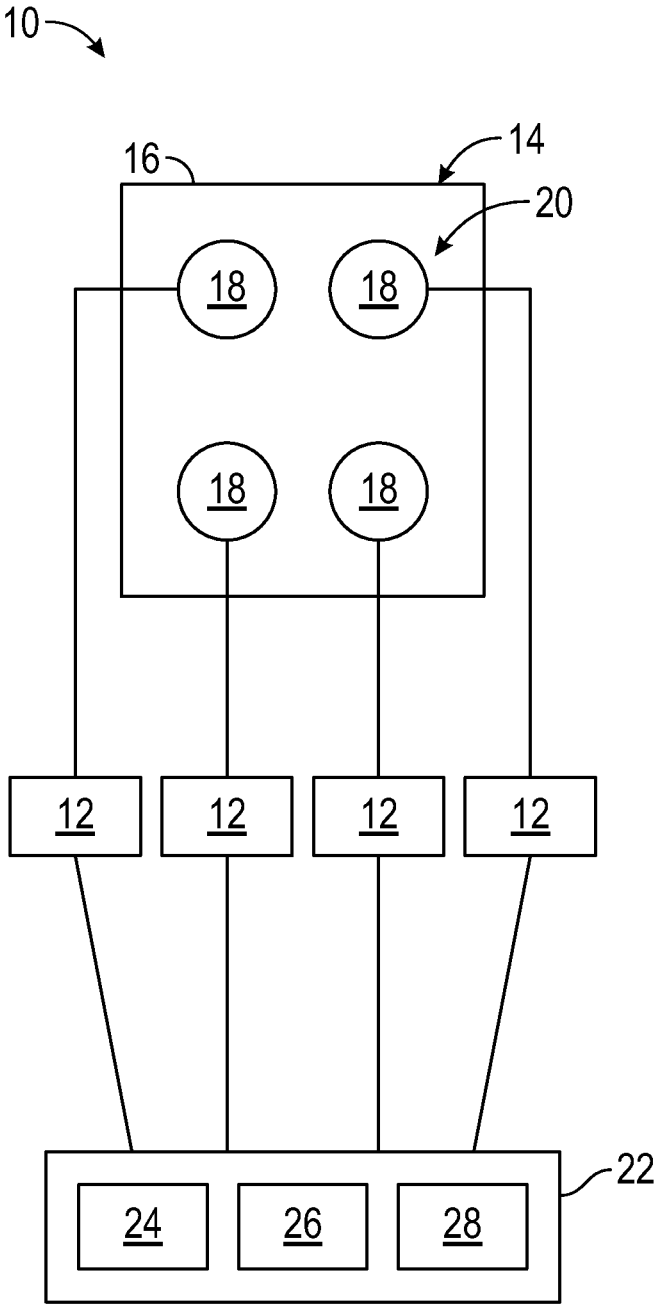
FIG. 1 is a schematic diagram of an exemplary embodiment of an antenna system.

FIG. 1 is a schematic diagram of an exemplary embodiment of an antenna system 10. The antenna system 10 includes a plurality of feed networks 12 and an antenna assembly 14. The antenna assembly 14 includes a ground plane 16 and one or more patch antennas 18 positioned on the ground plane 16. In the exemplary embodiment of the antenna system 10, the antenna assembly 14 includes an array 20 of four patch antennas 18. But, the array 20 may include any number of patch antennas 18, the antenna assembly 14 may include any number of the arrays 20, and the antenna assembly 14 may include any number of patch antennas 18 overall. In some embodiments, the antenna assembly 14 includes only a single patch antenna 18. The patch antennas 18 may be arranged within the array 20 in any other pattern than is shown in FIG. 1.

The antenna system 10 may function as a transmitting antenna system that transmits RF waves into the environment (e.g., the atmosphere) of the antenna system 10, as a receiving antenna system that receives RF waves from the environment of the antenna system 10, or as a combination of a transmitting and a receiving antenna system 10. Each patch antenna 18 is operatively connected to a corresponding feed network 12 for receiving RF waves from the corresponding feed network 12 and/or for delivering RF waves to the corresponding feed network 12. As shown in FIG. 1, each feed network 12 is operatively connected to one or more processing systems 22, which may or may not be considered a component of the antenna system 10. The operative connection of the feed networks 12 between the processing system 22 and the patch antennas 18 enables the feed networks 12 to feed RF energy between the patch antennas 18 and the processing system 22. Each feed network 12 may include one or more components (not shown) for converting RF waves received by the patch antennas 18 into RF electrical signals for delivery to the processing system 22, and/or vice versa. Optionally, another electrical circuit (not shown) is operatively connected between the feed networks 12 and the processing system 22 for combining the RF electrical signals that correspond to a plurality of patch antenna 18 and feed network 12 pairs.

The processing system 22 includes one or more transmitters 24, one or more receivers 26, and/or one or more transceivers 28. The inclusion of any transmitters 24, any receivers 26, and any transceivers 28 may depend on whether the antenna system 10 functions as a transmitting antenna system, as a receiving antenna system, or as a combination of a transmitting and a receiving antenna system. The processing system 22 may include any number of the transmitters 24, any number of the receivers 26, and any number of the transceivers 28, the number of each of which may or may not correspond to the number of patch antennas 18. The processing system 22 may include other components in addition to the transmitters 24, receivers 26, and transceivers 28.

Each patch antenna 18 may function as a receiving antenna, a transmitting antenna, or as both a receiving and a transmitting antenna. In other words, each of the patch antennas 18 may transmit RF waves into the environment, may receive RF waves from the environment, or may both transmit RF waves and receive RF waves. In some embodiments, all of the patch antennas 18 are receiving antennas that do not transmit RF waves. In other embodiments, all of the patch antennas 18 are transmitting antennas that do not receive RF waves from the environment, or all of the patch antennas 18 are transceiving antennas that both transmit RF waves and receive RF waves. In still other embodiments, the antenna assembly 14 includes a combination of one or more receiving patch antennas 18 that do not transmit RF waves, one or more transmitting patch antennas 18 that do not receive RF waves, and/or one or more transceiving patch antennas 18 that both transmit and receive RF waves.

In the exemplary embodiment of the antenna assembly 14, the ground plane 16 is shown as being common to all of the patch antennas 18. In other words, all of the patch antennas 18 are positioned on the same ground plane 16. Alternatively, the antenna assembly 14 includes more than one ground plane 16, with each ground plane 16 having one or more corresponding patch antennas 18 positioned thereon. In some embodiments, each patch antenna 18 is positioned on a different ground plane 16 than each other patch antenna 18. The ground plane(s) 16 may be considered to be a component of any patch antennas 18 that are positioned thereon.

The antenna system 10 may be any type of antenna system having any application, such as, but not limited to, a controlled reception pattern antenna (CRPA), a fixed reception pattern antenna (FRPA), a global positioning system (GPS) antenna, a global navigation satellite system (GNSS) antenna, and/or the like.

Figure 2:
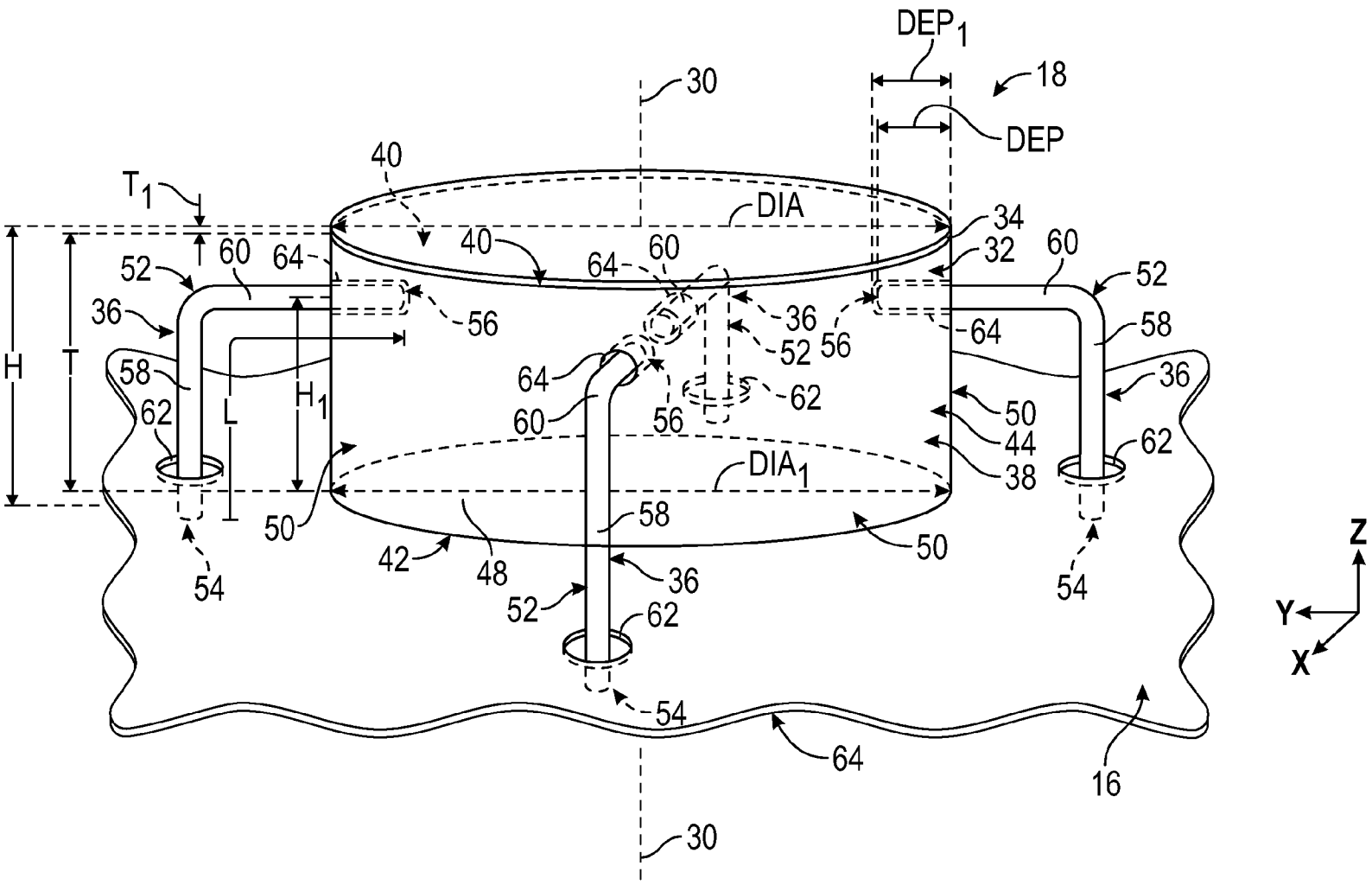
FIG. 2 is a perspective view of an exemplary embodiment of a patch antenna of the antenna system shown in FIG. 1.

FIG. 2 is a perspective view of an exemplary embodiment of one of the patch antennas 18. The patch antenna 18 extends a height H along a central axis 30. The patch antenna 18 includes a dielectric substrate 32, a radiating patch 34 positioned on the substrate 32, and a plurality of feed probes 36. The ground plane 16 is shown in FIG. 2 and may or may not be considered a component of the patch antenna 18. The feed probes 36 are electrically connected to the feed network 12 (FIG. 1) for exciting (i.e., energizing) the radiating patch 34. When excited by the feed probes 36, the patch antenna 18 is resonant and thereby transmits and/or receives RF waves.

The substrate 32 of the patch antenna 18 has a body 38 that includes opposite sides 40 and 42. The substrate body 38 extends a thickness T along the central axis 30 from the side 40 to the side 42. The substrate body 38 has a diameter $DIA_1$. The substrate body 38 includes one or more side walls 44 that extend along the thickness T of the body 38 from the side 40 to the side 42. In the exemplary embodiment of the substrate 32, a cross section of the substrate body 38 taken along an x-y plane (which extends approximately perpendicular to central axis 30) has the shape of a circle. Accordingly, the substrate body 38 includes a single continuous side wall 44 in the exemplary embodiment. But, the substrate body 38 may include a greater number of side walls 44 in embodiments wherein the substrate body 38 has a different cross-sectional shape taken along the x-y plane. The side 40 of the substrate body 38 may be referred to herein as a "first" side, while the side 42 may be referred to herein as a "second" side.

The side wall 44 of the substrate body 38 has an exterior surface 48 that defines a perimeter 50 of the substrate body 38. Specifically, the perimeter 50 is a radial perimeter wherein the exterior surface 48 defines the portions of the body 38 that extend radially outermost relative to the central axis 30. It should be understood that the perimeter 50 will be defined by the exterior surfaces 48 of a plurality of side walls 44 in embodiments wherein the cross-sectional shape of substrate body 38 provides the body 38 with more than one side wall 44.

The body 38 of the substrate 32 is a solid body. By a "solid body", it is meant that the material of at least a majority of the substrate body 38 is in the solid phase. The solid body 38 of the substrate 30 can be distinguished from a non-solid body wherein a majority of the material of the body is in gaseous and/or liquid phase. As used herein, a "solid body" may include one or more portions having material that is in the gaseous phase (e.g., air and/or the like) and/or may include one or more portions having material that is in the liquid phase (e.g., water and/or the like), for example contained within one or more internal pockets (not shown) of the solid body. In the exemplary embodiment of the substrate 32, the material of an approximate entirety of the material substrate body 38 is in the solid phase. But, as should be appreciated from above, the body 38 of the substrate 32 may alternatively include one or more pockets of a gaseous and/or a liquid material and still be considered a "solid body".

The substrate body 38 has a dielectric constant that is greater than the dielectric constant of air. Specifically, air has a dielectric constant of approximately 1.001. The substrate body 38 may have any dielectric constant that is greater than approximately 1.001. In some embodiments, the body 38 of the substrate 32 has a dielectric constant of greater than approximately 2.0, greater than approximately 5.0, and/or greater than approximately 10.0. The substrate body 38 may be fabricated from any material that provides the substrate body 38 with a dielectric constant that is greater than air. Examples of suitable materials for the substrate body 38 include, but are not limited to, ceramic, rubber, fluoropolymer, composite material, fiber-glass, plastic, and/or the like. In one non-limiting example of the substrate body 38, the substrate body 38 is fabricated from a ceramic and has a dielectric constant of approximately 13.0.

As discussed above, a cross section of the substrate body 38 taken along an x-y plane has the shape of a circle in the exemplary embodiment of the substrate 32. But, the substrate body 38 may additionally or alternatively have any other cross-sectional shape taken along an x-y plane. Other examples of the cross-sectional shape of the substrate body 38 taken along an x-y plane include, but are not limited to, square, rectangular, oval, closed curves, triangular, trapezoidal, shapes having more than four sides, and/or the like. Moreover, although shown as being approximately constant along the thickness T, the diameter $DIA_1$ of the substrate body 38 may alternatively be variable along the thickness T. In other words, the diameter $DIA_1$ of the substrate body 38 may be variable within a cross section of the substrate body 38 taken along an x-z and/or a y-z plane. For example, the substrate body 38 may be tapered such that the diameter $DIA_1$ gets progressively smaller or progressively larger as the thickness T extends from the ground plane 16 toward the radiating patch 34. Examples of the cross-sectional shape of the substrate 32 taken along an x-z and/or a y-z plane include, but are not limited to, trapezoidal, triangular, hourglass shapes, and/or the like.

As shown in FIG. 2, the substrate 32 of the patch antenna 18 is positioned on the ground plane 16 such that the side 42 of the substrate body 38 is engaged in physical contact with the ground plane 16. In other words, the ground plane 16 is positioned on the side 42 of the substrate body 38. The radiating patch 34 is positioned on the side 40 of the substrate body 38 that is opposite the side 42. The thickness T of the substrate body 38 thus spaces the radiating patch 34 apart from the ground plane 16. The radiating patch 34 has a diameter DIA and a thickness $T_1$.

The radiating patch 34 is electrically conductive and may be fabricated from any electrically conductive material, such as, but not limited to, copper, gold, silver, aluminum, tin, and/or the like. The diameter DIA and the thickness $T_1$ of the radiating patch 34 may each have any suitable value that enables the patch antenna 18 to function as described and/or illustrated herein. Although shown as having approximately the same size as the substrate body 38 in the x and y directions, the radiating patch 34 may be larger or smaller than the substrate body 38 in the x direction and/or may be larger or smaller than the substrate body 38 in the y direction. For example, although the diameter DIA of the radiating patch 34 is shown has having approximately the same value as the diameter $DIA_1$ of the substrate body 38, the diameter DIA of the radiating patch 34 may be greater or less than the diameter $DIA_1$ of the substrate body 38. Moreover, although shown as having the same general circular cross-sectional shape as the substrate body 38 taken along an x-y plane, the radiating patch 34 may alternatively have a different cross-sectional shape than the substrate body 38 taken along an x-y plane. Other examples of the cross-sectional shape of the radiating patch 34 taken along an x-y plane include, but are not limited to, square, rectangular, oval, closed curves, triangular, trapezoidal, shapes having more than four sides, and/or the like.

The ground plane 16 may be fabricated from any electrically conductive material, such as, but not limited to, copper, gold, silver, aluminum, tin, and/or the like. In the exemplary embodiment of the patch antenna 18, the ground plane 16 is larger than the radiating patch 34 in both the x and y directions. But, the ground plane 16 may be smaller or approximately the same size as the radiating patch 34 in the x direction and/or may be smaller or approximately the same size as the radiation patch 34 in the y direction. The ground plane 16 may have any size in the x direction and any size in the y direction relative to the radiating patch 34 that enables the patch antenna 18 to function as described and/or illustrated herein, whether or not the ground plane 16 is common to more than one patch antenna 18 of the antenna assembly 14 (FIG. 1). Although shown as having a circular cross-sectional shape taken along an x-y plane, the ground plane 16 may alternatively have a different cross-sectional shape taken along an x-y plane, such as, but not limited to, square, rectangular, oval, closed curves, triangular, trapezoidal, shapes having more than four sides, and/or the like.

As described above, the feed probes 36 are electrically connected to the feed network 12 for exciting the radiating patch 34. In the exemplary embodiment of the patch antenna 18, each feed probe 36 includes an L-shaped pin 52 that extends a length from an end 54 to an opposite end 56. The L-shape of the pin 52 is defined by two segments 58 and 60 of the pin 52 that are angled with respect to each other. In the exemplary embodiment of the feed probes 36, the segments 58 and 60 are angled at approximately 90° relative to each other. But, the segments 58 and 60 of each pin 52 may be angled at any other angle that enables the feed probe 36 to function as described and/or illustrated herein, for example an angle that is between approximately 0° and approximately 90° or an angle that is between approximately 90° and approximately 180°.

The segments 58 and 60 of each pin 52 include the ends 54 and 56, respectively. The end 54 of each pin 52 is electrically connected to the feed network 12. As can be seen in FIG. 2, the segment 58 of each pin 52 extends through a corresponding thru-opening 62 of the ground plane 16. The end 54 of each pin 52 is thus exposed on a side 64 of the ground plane 16 for electrical connection to the feed network 12. Other arrangements of the pin segments 58 for electrical connection to the feed network may be used in other embodiments. The ground plane 16 may include any number of the thru-openings 62 for any number of pins 52.

The other end 56 of each pin 52 interfaces with the substrate 32. For example, the end 56 of each pin 52 is received within a corresponding opening 64 of the substrate body 38 in the exemplary embodiment shown in FIG. 2. Specifically, the body 38 of the substrate 32 includes a plurality of the openings 64, which extend into the side wall 44 at spaced apart locations along the perimeter 50 of the substrate body 38. Each opening 64 extends a depth DEP into the substrate body 38. In the exemplary embodiment of the substrate 32, the openings 64 extend into the substrate body 38 at an approximately perpendicular angle relative to the central axis 30. But, each opening 64 may extend into the substrate body 38 at any other angle relative to the central axis 30 that enables the feed probe 36 to function as described and/or illustrated herein, for example an angle that is between approximately 0° and approximately 90° with respect to the central axis 30 or an angle that is between approximately 90° and approximately 180° with respect to the central axis 30. The depth DEP of each opening 64 may have any suitable value.

As can be seen in FIG. 2, the segment 60 of each pin 52 extends into the corresponding opening 64 such that the end 56 of the pin 52 is received within the opening 64. The segment 60 of each pin 52 extends a depth $DEP_1$ into the corresponding opening 64. The depth $DEP_1$ of each segment 60 may have any value, which may be approximately equal to or less than the depth DEP of the corresponding opening 64. In the exemplary embodiment of the feed probes 36, the depth $DEP_1$ of each segment 60 is less than depth DEP of the corresponding opening 64. Moreover, the openings 64 are positioned along the thickness T of the substrate body 38 at a height $H_1$ relative to the ground plane 16 such that the segments 60 of the pins 52 interface with the substrate 32 at the height $H_1$. The height $H_1$ may have any value. In the exemplary embodiment of the patch antenna 18, the height $H_1$ is greater than approximately half of the thickness T of the substrate body 38.

Moreover, in the exemplary embodiment of the feed probes 36, the segment 60 of each pin 52 is disengaged from physical contact with the substrate body 38 within the corresponding opening 64. In other words, the segments 60 do not engage the interior walls of the substrate body 38 that define the openings 64. Alternatively, the segment 60 of one or more pins 52 is engaged in physical contact with the substrate body 38 within the corresponding opening 64.

Although shown as having a circular cross-sectional shape, each of the pins 52 may include any other cross-sectional shape, such as, but not limited to, square, rectangular, oval, closed curves, shapes having more than four sides, and/or the like. Moreover, each of the openings 64 may each have any cross-sectional shape, whether or not the cross-sectional shape of the opening 64 is the same as the cross-sectional shape of the corresponding pin 52.

Other arrangements of the interface between the feed probes 36 and the substrate 32 may be used in other embodiments. Non-limiting examples of some of such other arrangements of the interface between the feed probes and the substrate 32 are described below with respect to FIGS. 7 and 8.

Figure 3:
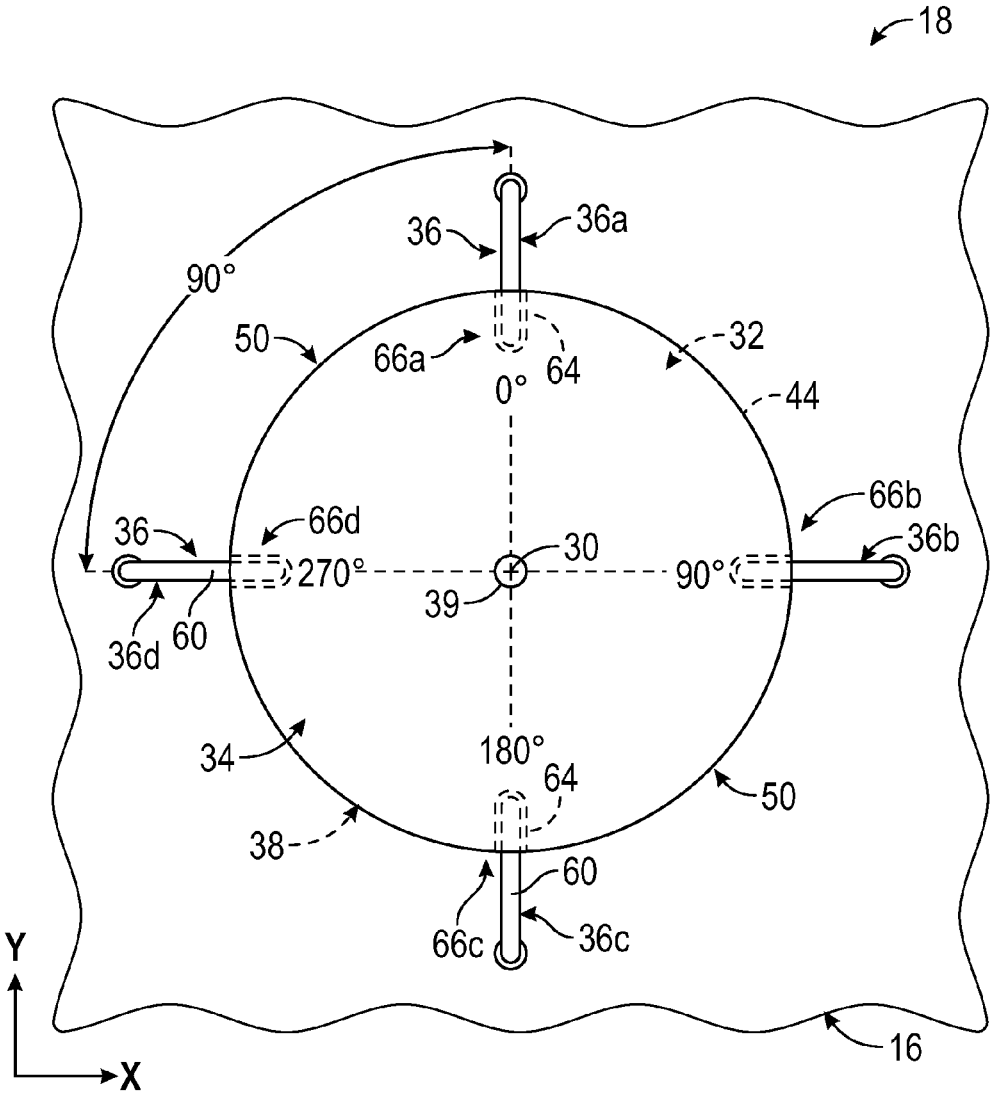
FIG. 3 is a plan view of the patch antenna shown in FIG. 2.

FIG. 3 is a plan view of the patch antenna 18 shown in FIG. 2. The feed probes 36 are electromagnetically coupled to the radiating patch 34 for generating a circularly polarized radiation pattern, which causes the patch antenna 18 to radiate circularly polarized electromagnetic waves. In addition to perfectly circular radiation patterns and electromagnetic waves, a "circularly polarized radiation pattern" and "circularly polarized electromagnetic waves", as used herein, each also include radiation patterns and electromagnetic waves, respectively, that do not have perfectly circular shapes, such as, but not limited to, elliptical shapes and/or the like. Moreover, the term "electromagnetically coupled" is intended to indicate that the feed probes 36 do not physically contact the radiating patch 34. The exemplary embodiment of the patch antenna 18 includes four feed probes 36*a*, 36*b*, 36*c*, and 36*d* that are positioned relative to the substrate body 38 such that adjacent feed probes 36 are spaced apart from each other along the substrate body 38. In the exemplary embodiment of the patch antenna 18, the four feed probes 36*a*, 36*b*, 36*c*, and 36*d* are positioned around the perimeter 50 of the substrate body 38 in the spaced apart relationship from each other, as can be seen in FIG. 3. Specifically, the openings 64 of the side wall 44 are spaced apart from each other along the perimeter 50 in the exemplary embodiment of the patch antenna 18. Accordingly, the segments 60 of the feed probes 36 that extend into the openings 64 are spaced apart from each other along the perimeter 50.

The excitation phase and the angular orientation (i.e., the spacing pattern along the substrate body 38) of each of the four feed probes 36*a*, 36*b*, 36*c*, and 36*d* are selected to generate a circularly polarized radiation pattern. Specifically, the four feed probes 36*a*, 36*b*, 36*c*, and 36*d* feed the radiating patch 34 at four respective locations 66*a*, 66*b*, 66*c*, and 66*d* of approximately equal power amplitude, with each location being progressively delayed in phase (e.g., by approximately 90°. The feed network 12 (FIG. 1) may include one or more various components (not shown) for controlling the phase of each of the feed probes 36*a*, 36*b*, 36*c*, and 36*d*, such as, but not limited to, baluns, hybrid couplers, delay lines, and/or the like. For patch antennas of square or rectangular x-y cross sections, the relative spacing and phase delay of the four feed probes 36*a*, 36*b*, 36*c*, and 36*d* excites two different modes (e.g., orthogonal modes such as, but not limited to, $TM_{010}$ and $TM_{001}$) that are of approximately equal power amplitude but are delayed in phase with respect to each other. The different modes radiate separately and combine to generate electromagnetic fields that rotate in time, thereby generating circularly polarized electromagnetic waves. For patch antennas of circular x-y cross section, the relative spacing and phase delay of the four feed probes 36*a*, 36*b*, 36*c*, and 36*d* excite a single mode (e.g., modes such as, but not limited to, $TM_{110}$, $T_{210}$, $TM_{310}$, or $TM_{410}$) with a circular field distribution. The rotation of the electromagnetic fields in time generates circularly polarized electromagnetic waves. Patch antennas of other x-y cross sections create rotating electromagnetic fields through exciting a combination of multiple modes.

The spacing along the substrate body 38 and the phase delay between the locations of adjacent feed probes 36 may be selected to configure the patch antenna 18 to operate at one or more predetermined modes. The patch antenna 18 may operate at any mode, such as, but not limited to, $TM_{110}$, $TM_{210}$, $TM_{310}$, and/or $TM_{410}$, and/or the like. In the exemplary embodiment of the patch antenna 18, circular polarization for the mode of $TM_{110}$ is achieved by spacing the feed probes 36 apart by approximately 90° along the perimeter 50 of the substrate 32 and controlling the phases of the feed probes 36 such that the feed probes 36 are configured to feed the radiating patch 34 with a progressive 90° phase shift. In other words, the feed probes 36 are spaced apart along the perimeter 50 with an approximate equal spacing from one another and the center of the radiating patch 34 such that adjacent feed probes 36 along the perimeter are delayed by a phase shift of approximately 90° with respect to each other. For example, as shown in FIG. 3, the feed probes 36*a*, 36*b*, 36*c*, and 36*d* have angular orientations of approximately 0°, approximately 90°, approximately 180°, and approximately 270°, respectively, and the feed probes 36*a*, 36*b*, 36*c*, and 36*d* have phases of approximately 0°, approximately 90°, approximately 180°, and approximately 270°, respectively.

Although the exemplary embodiment of the patch antenna 18 includes four feed probes 36*a*, 36*b*, 36*c*, and 36*d* to excite the radiating patch 34, it is contemplated that the patch antenna 18 could alternatively use only three feed probes 36 or a greater number of feed probes 36 than four. In embodiments wherein three or more than four feed probes 36 are used, the feed probes 36 may be spaced apart along the substrate body 38 with an approximate equal spacing from one another and the center of the radiating patch 34 such that adjacent feed probes 36 along the perimeter are delayed by a predetermined phase shift. Moreover, in addition to the feed probes 36, the patch antenna 18 may include one or more additional electrically conductive pins positioned within the substrate body 38, for example the electrically conductive pin 39 shown in FIG. 3. The conductive pin 39 extends a length that extends along the central axis 30. Although shown as being aligned with the central axis 30 such that the conductive pin 39 is positioned at the center of the substrate body 38, the conductive pin 39 may be positioned at any other x-y location along the substrate body 38. Moreover, the conductive pin 39 may extend any length and may be positioned at any position along the thickness T (FIG. 2) of the substrate body 38. In the exemplary embodiment of the conductive pin 39, the conductive pin 39 extends along an approximate entirety of the thickness T from the side 40 to the side 42. The conductive pins 39 have any orientation within the substrate body 38 relative to the central axis 30.

Figure 4:
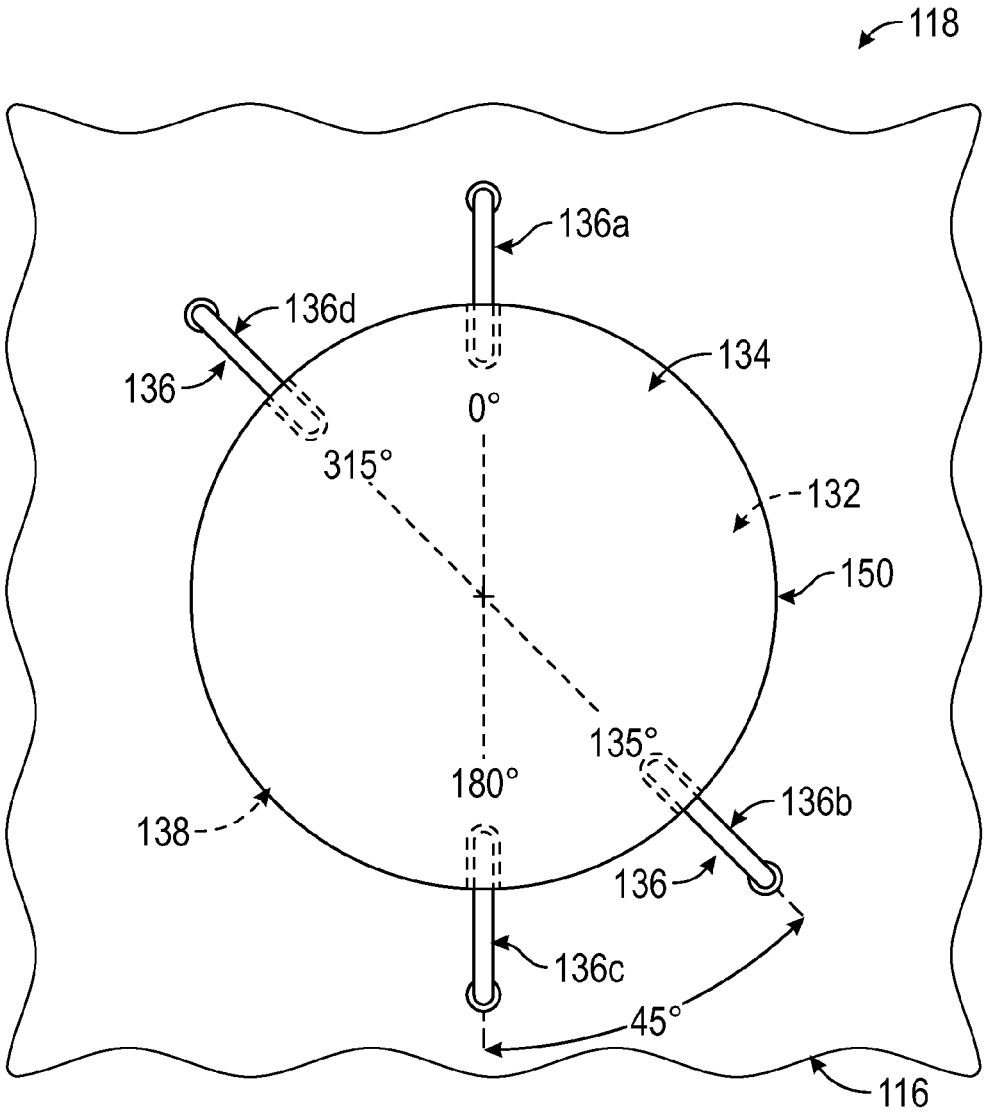
FIG. 4 is a plan view of another exemplary embodiment of a patch antenna.

Other spacing patterns of the feed probes 36 may be used in other embodiments. For example, FIG. 4 is a plan view of another exemplary embodiment of a patch antenna 118. The patch antenna 118 includes a dielectric substrate 132, a radiating patch 134 positioned on the substrate 132, and four feed probes 136, namely feed probes 136*a*, 136*b*, 136*c*, and 136*d*. A ground plane 116 may or may not be considered a component of the patch antenna 118.

The four feed probes 136*a*, 136*b*, 136*c*, and 136*d* are positioned around a perimeter 150 of a body 138 of the substrate 132 in a spaced apart relationship, as can be seen in FIG. 4. In the exemplary embodiment of the patch antenna 118, the spacing along the perimeter 150 and the phase delay between the feed probes 136 is selected to configure the patch antenna 18 to operate at the mode $TM_{210}$. Circular polarization for the mode of $TM_{210}$ is achieved by spacing the feed probes 136 apart along the perimeter 150 and controlling the phases of the feed probes 136 such that: the feed probes 136*a*, 136*b*, 136*c*, and 136*d* have angular orientations of approximately 0°, approximately 135°, approximately 180°, and approximately 315°, respectively; and the feed probes 136*a*, 136*b*, 136*c*, and 136*d* have phases of approximately 0°, approximately 90°, approximately 0°, and approximately 90°, respectively.

Figure 5:
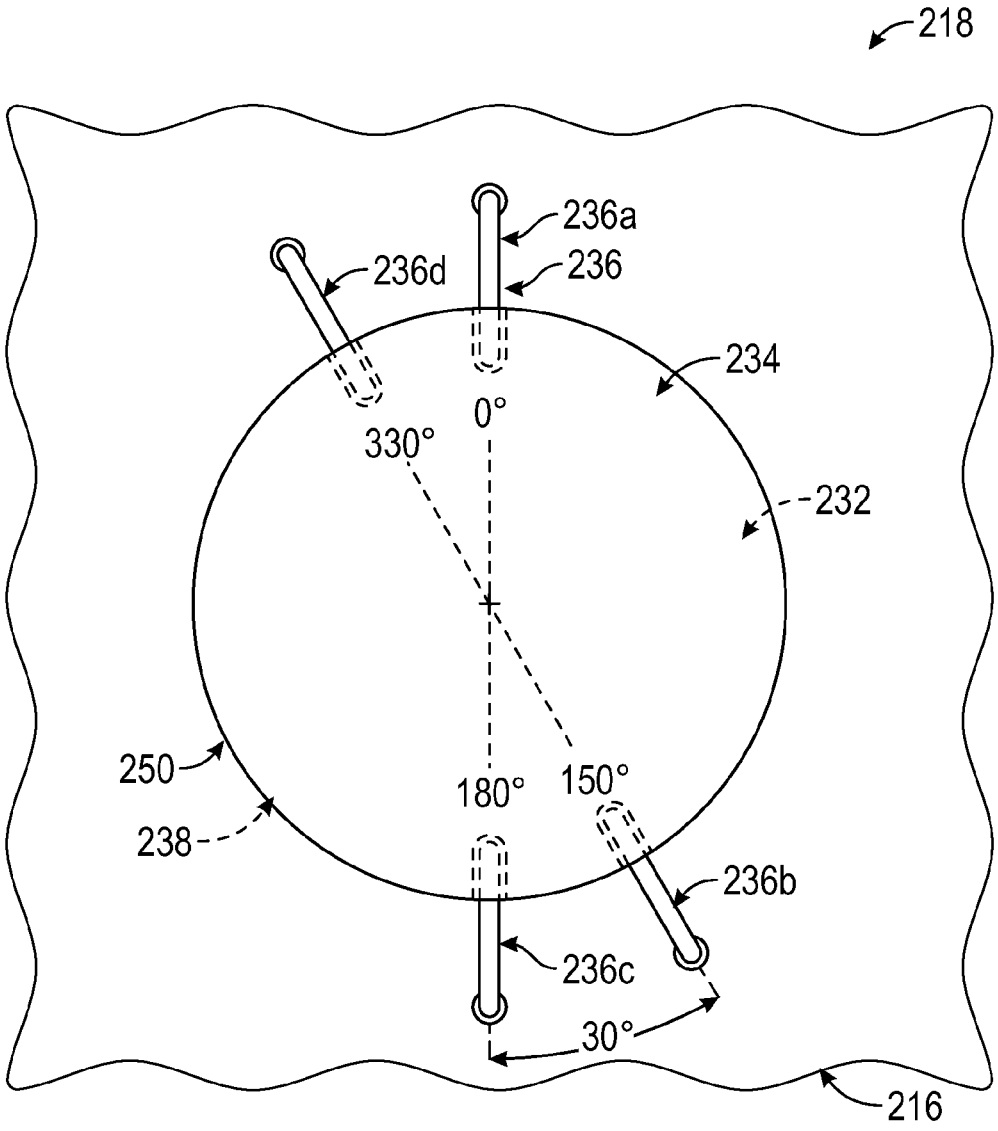
FIG. 5 is a plan view of another exemplary embodiment of a patch antenna.

Moreover, and for example, FIG. 5 is a plan view of another exemplary embodiment of a patch antenna 218 configured to operate in the mode $TM_{310}$. The patch antenna 218 includes a dielectric substrate 232, a radiating patch 234 positioned on the substrate 232, and four feed probes 236. The four feed probes 236*a*, 236*b*, 236*c*, and 236*d* are positioned around a perimeter 250 of a body 238 of the substrate 232 in a spaced apart relationship. The spacing along the perimeter 250 and the phase delay between the feed probes 236 is selected to configure the patch antenna 218 to operate at the mode $TM_{310}$. Circular polarization for the mode of $TM_{310}$ is achieved by spacing the feed probes 236 apart along the perimeter 250 and controlling the phases of the feed probes 236 such that: the feed probes 236*a*, 236*b*, 236*c*, and 236*d* have angular orientations of approximately 0°, approximately 150°, approximately 180°, and approximately 335°, respectively; and the feed probes 236*a*, 236*b*, 236*c*, and 236*d* have phases of approximately 0°, approximately 90°, approximately 180°, and approximately 270°, respectively. A ground plane 216 may or may not be considered a component of the patch antenna 218.

Figure 6:
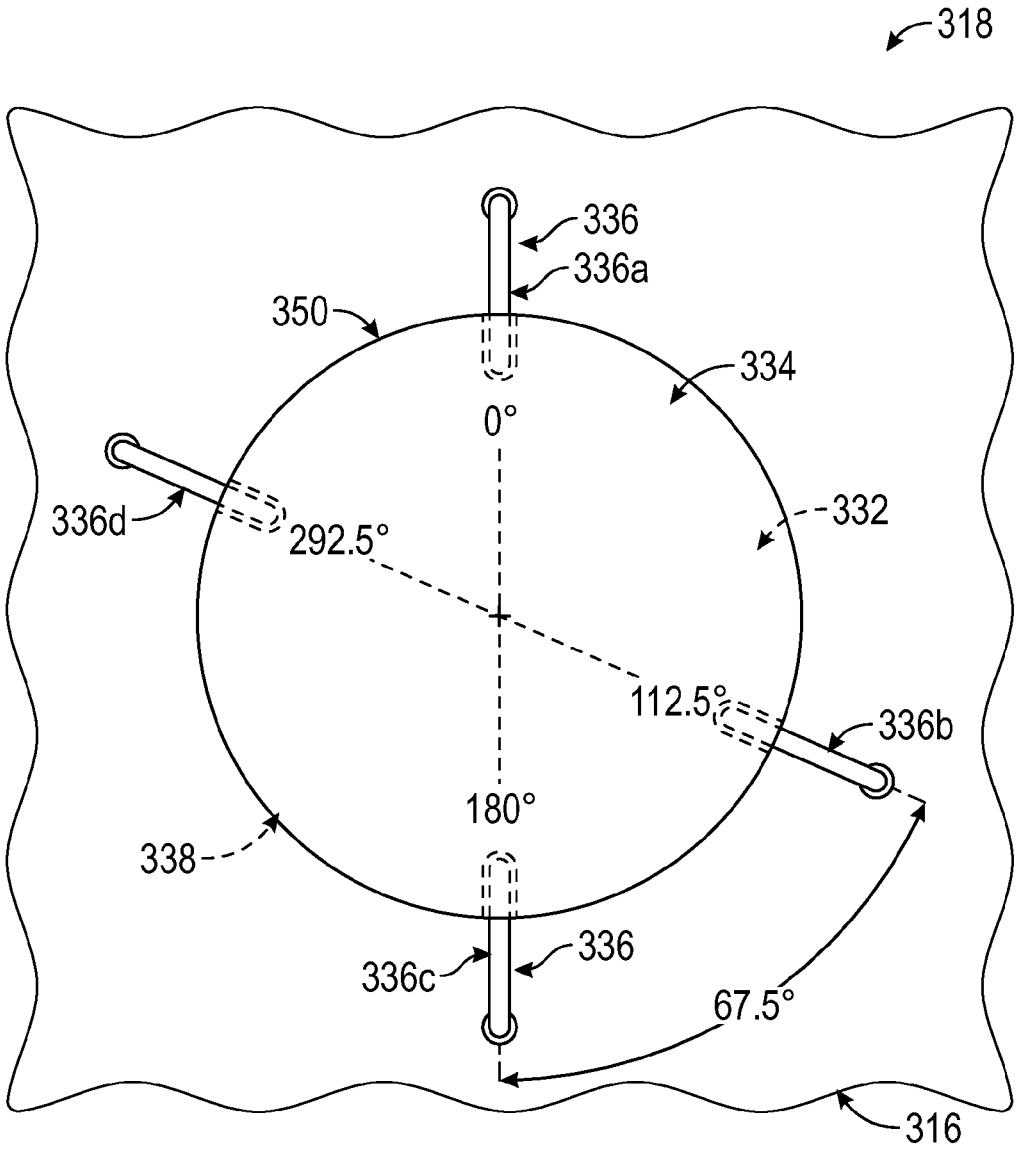
FIG. 6 is a plan view of another exemplary embodiment of a patch antenna.

FIG. 6 is a plan view of another exemplary embodiment of a patch antenna 318 configured to operate in the mode $TM_{410}$. The patch antenna 318 includes a dielectric substrate 332, a radiating patch 334 positioned on the substrate 332, and four feed probes 336. The four feed probes 336*a*, 336*b*, 336*c*, and 336*d* are positioned around a perimeter 350 of a body 338 of the substrate 332 in a spaced apart relationship. The spacing along the perimeter 350 and the phase delay between the feed probes 336 is selected to configure the patch antenna 318 to operate at the mode $TM_{410}$. Circular polarization for the mode of $TM_{410}$ is achieved by spacing the feed probes 336 apart along the perimeter 350 and controlling the phases of the feed probes 336 such that: the feed probes 336*a*, 336*b*, 336*c*, and 336*d* have angular orientations of approximately 0°, approximately 112.5°, approximately 180°, and approximately 292.5°, respectively; and the feed probes 236*a*, 236*b*, 236*c*, and 236*d* have phases of approximately 0°, approximately 90°, approximately 0°, and approximately 90°, respectively. A ground plane 316 may or may not be considered a component of the patch antenna 318.

Referring again to FIG. 2 and the patch antenna 18, in operation, the patch antenna 18 transmits RF waves into the environment and/or receives RF waves from the environment. Specifically, the patch antenna 18 resembles a dielectric loaded cavity. The electric and magnetic fields within the patch antenna 18 can be found by treating the patch antenna 18 as a cavity resonator. The feed probes 36 may be configured to efficiently excite the desired cavity mode while suppressing undesirable cavity modes. The desired cavity mode of the patch antenna 18 is well excited when the feed probes 36 are relatively well coupled to the patch antenna 18 at the maxima of the desired mode's field distribution within the cavity. The feed probes 36 may provide a relatively efficient impedance match between the patch antenna 18 and the processing system 22 (FIG. 1). In addition, the feed probes 36 may be configured such that the input reactance of the feed probes 36 is minimized. Additional length L of the feed probes 36 increases feed probe inductance, while the distance of the feed probes 36 to the radiating patch 34 and/or the ground plane 16 increase the capacitance of the feed probes 36. Adjusting the length L of the feed probes 36 and/or the height $H_1$ may enable the reactance of the feed probes 36 to be minimized, which may increase the performance of the patch antenna 18. "Performance" of the patch antenna 18 is intended to mean the ability of the patch antenna 18 to excite the desirable mode but still suppress any undesirable modes (e.g., higher-order modes).

The patch antenna 18 may operate at any frequencies. By "operate", it is meant that the patch antenna 18 is capable of transmitting and/or receiving RF waves at the particular frequencies. Examples of the operating frequencies of the patch antenna 18 include, but are not limited to, frequencies above approximately 0.50 GHz, frequencies above approximately 1.00 GHz, frequencies below approximately 3.00 GHz, frequencies below approximately 2.00 GHz, frequencies between approximately 1.00 GHz and 2.00 GHz, and/or the like. The patch antenna 18 may operate over a frequency band having any bandwidth. Examples of the bandwidth of the operational frequency band of the patch antenna 18 include, but are not limited to, approximately 100 MHz, approximately 400 MHz, approximately 500 MHz, approximately 600 MHz, and/or the like. The patch antenna 18 may have an increased bandwidth as compared to at least some known patch antennas 18. For example, some known patch antennas 18 have a bandwidth of only approximately 5 MHz, while other known patch antennas 18 may have a bandwidth of up to 24 MHz.

Various parameters of the patch antenna 18 may be selected to provide the patch antenna 18 with predetermined operating frequencies and/or with a predetermined bandwidth. For example, the diameter DIA of the radiating patch 34, the diameter(s) $DIA_1$ of the substrate body 38 (which may be variable or constant along the thickness T as is described above), the value of the thickness T of the substrate body 38, and/or the dielectric constant of the substrate body 38 may be selected to provide the patch antenna 18 with predetermined operating frequencies and/or with a predetermined bandwidth, for example to provide the increased bandwidth and/or reduced size relative to at least some known patch antennas. In some embodiments, the thickness T of the substrate body 38 is at least approximately 0.2 times the wavelength in the substrate 32. Substrate thicknesses T of the patch antenna 18 that are greater than approximately 0.05 wavelengths to approximately 0.7 wavelengths may facilitate increasing the bandwidth of the patch antenna 18 over the bandwidth of at least some known patch antennas 18. The bandwidth of the patch antenna 18 is inversely proportional to the square root of the dielectric constant of the substrate body 38, and directly proportional to the thickness T of the substrate body 38.

Moreover, various parameters of the feed probes 36 may be selected to provide the patch antenna 18 with predetermined operating frequencies and/or with a predetermined bandwidth. Examples of such various parameters of the feed probes 36 include, but are not limited to, the number of feed probes 36 used, the depth $DEP_1$ that each feed probe 36 extends into the substrate body 38, the height $H_1$ of the openings 64, the angle that the pins 52 extend into the substrate body 38, the size (e.g., diameter) of the pins 52, whether the pins 52 engage the substrate body 38 within the openings 64, the amount of space between the pins 52 and the substrate body 38 within the openings 64, and/or the like. As discussed above, the inclusion of four feed probes 36 (e.g., as compared to using only two feed probes 36) may facilitate providing the patch antenna 18 with a greater bandwidth than at least some known patch antennas 18. For example, in an antenna assembly 14 (FIG. 1), the inclusion of four feed probes 36 may reduce mutual coupling between patch antennas 18 a greater amount than including only two feed probes 36. Moreover, and for example, the inclusion of four feed probes 36 may suppress undesirable modes (e.g., higher-order modes), which may lead to an improvement in radiation purity.

The patch antenna 18 may have any size. For example, the overall x dimension of the patch antenna 18, the overall y dimension of the patch antenna 18, the diameter DIA of the radiating patch 34 and the diameter(s) $DIA_1$ of the substrate body 38 (which may be variable or constant along the thickness T as described above) may each have any value. Examples of the values of each of the overall x dimension of the patch antenna 18, the overall y dimension of the patch antenna 18, the diameter DIA of the radiating patch 34, and the diameter(s) $DIA_1$ of the substrate body 38 include, but are not limited to, less than approximately 102 mm (4.0 inches), less than approximately 76 mm (3.0 inches), less than approximately 51 mm (2.0 inches), between approximately 25 mm (1 inch) and approximately 76 mm (3.0 inches), between approximately 51 mm (2.0 inches) and approximately 102 mm (4.0 inches), between approximately 35.6 mm (1.4 inches) and approximately 40.6 mm (1.6 inches), and/or the like. It should be understood that the exemplary dimensions described herein of the diameters DIA and $DIA_1$ are applicable to any lengths and/or widths of the patch antenna 18 in embodiments wherein the patch antenna 18 has a cross-sectional shape along the x-y plane that is non-circular. The patch antenna 18 may be smaller than at least some known patch antennas. For example, at least some known patch antennas 18 have a width, length, and/or diameter that is at least 76 mm (3.0 inches).

Various parameters of the patch antenna 18 may be selected to provide the patch antenna 18 with a predetermined size, for example with predetermined values for the diameters DIA and $DIA_1$. For example, the dielectric constant of the substrate body 38 may be selected to provide the patch antenna 18 with the predetermined size, for example to provide the reduced size as compared to at least some known patch antennas. Generally, for a given resonant frequency of the patch antenna 18, the diameter DIA of the radiating patch 34 is inversely proportional to the square root of the dielectric constant of the substrate body 38 such that as the dielectric constant is increased, the size of the patch antenna 18 is reduced. Moreover, the width, length, and/or diameter of the patch antenna 18 is approximately one half of a wavelength at the center of the frequency band. Accordingly, as the dielectric constant of the substrate body 38 is increased, the wavelength of the patch antenna 18 is reduced, thereby enabling the overall x and/or y dimensions (e.g., an overall length, an overall width, and/or an overall diameter) of the patch antenna 18 to be reduced. Generally, the bandwidth of a patch antenna is inversely related to the dielectric constant of the substrate of the patch antenna such that as the dielectric constant is increased, the bandwidth of the patch antenna is reduced. But, in the patch antenna 18, such a loss in bandwidth can be compensated for by increasing the thickness T of the substrate body 38.

Figure 7:
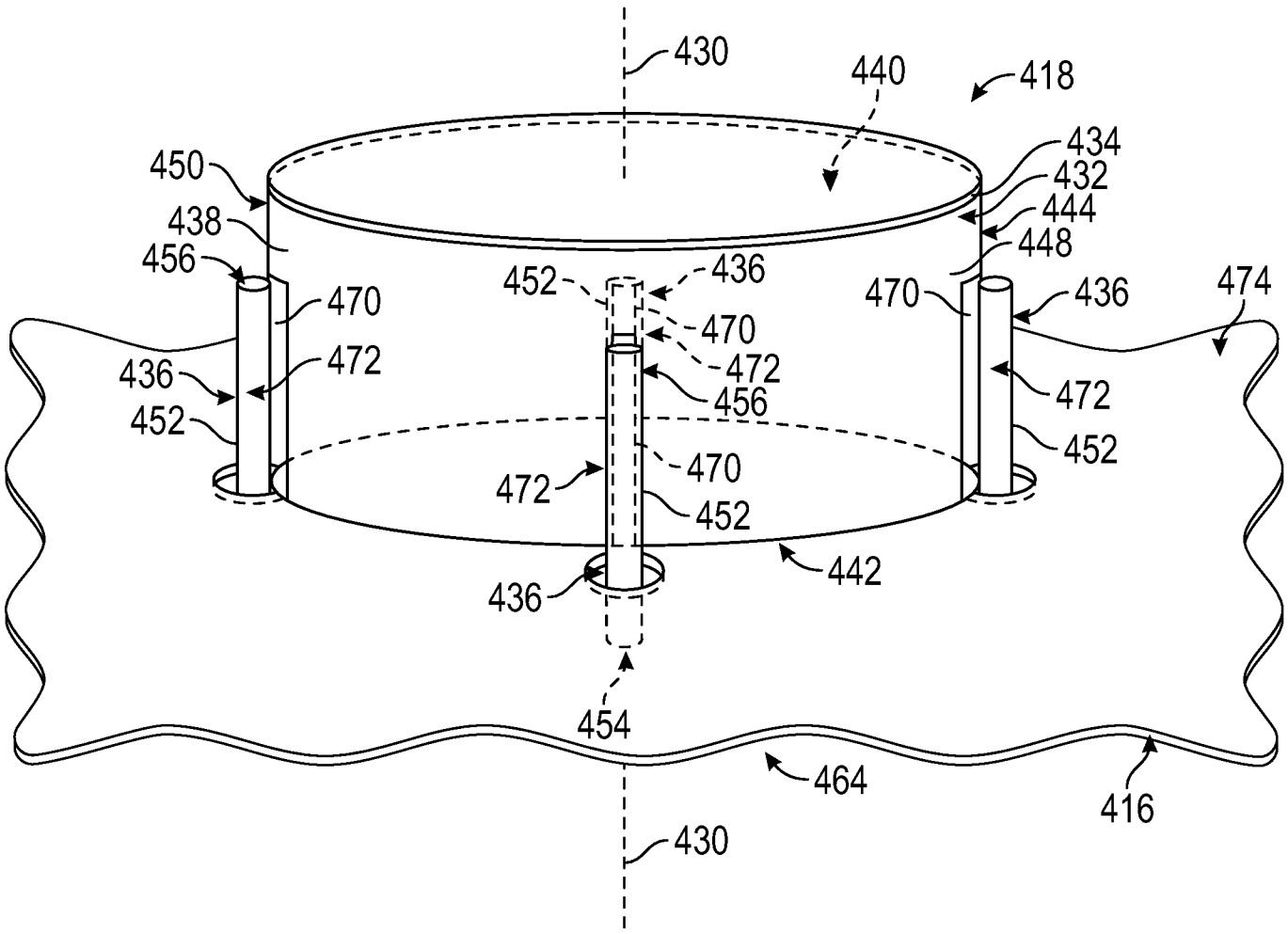
FIG. 7 is a perspective view of another exemplary embodiment of a patch antenna.

FIG. 7 is a perspective view of another exemplary embodiment of a patch antenna 418 illustrating another exemplary embodiment of an arrangement of the interface between feed probes 436 and a substrate 432 of the patch antenna 418. The patch antenna 418 extends a height along a central axis 430 and includes a dielectric substrate 432, a radiating patch 434 positioned on the substrate 432, and a plurality of feed probes 436. The ground plane 416 shown in FIG. 7 and may or may not be considered a component of the patch antenna 418.

The substrate 432 of the patch antenna 418 has a body 438 that includes opposite sides 440 and 442. The substrate body 438 extends a thickness along the central axis 430 from the side 440 to the side 442. The substrate body 438 includes one or more side walls 444 that extend along the thickness of the body 438 from the side 440 to the side 442. The side wall 444 of the substrate body 438 has an exterior surface 448 that defines a perimeter 450 of the substrate body 438. The substrate 432 is positioned on the ground plane 416 such that the side 442 of the substrate body 438 is engaged in physical contact with the ground plane 416. The radiating patch 434 is positioned on the side 440 of the substrate body 438 that is opposite the side 442. The side 440 of the substrate body 438 may be referred to herein as a "first" side, while the side 442 may be referred to herein as a "second" side.

The substrate 432 includes electrically conductive strips 470 positioned on the side wall 444 of the body 438. The strips 470 are spaced apart along the perimeter 450 of the substrate body 438, as is shown in FIG. 7. In the exemplary embodiment of the patch antenna 418, each feed probe 436 includes an approximately straight pin 452 that extends a length from an end 454 to an opposite end 456. Only one of the ends 454 is shown in FIG. 7. The end 454 of each pin 452 is electrically connected to the feed network 12 (FIG. 1). In the exemplary embodiment of the feed probes 436, the end 454 of each pin 452 is exposed on a side 464 of the ground plane 416 for electrical connection to the feed network 12.

The pins 452 interface with the substrate 432 along segments 472 of the pins 452 that extend on a side 474 of the ground plane 416 that is opposite the side 464. The lengths of the pins 452 extend along the central axis 430 and thus along the thickness of the body 438. The pins 452 are positioned around the perimeter 150 of the substrate body 438 such that the segment 472 of each pin 452 is electrically connected to a corresponding strip 470. In the exemplary embodiment of the patch antenna 418, the segments 472 of the pins 452 are soldered to the corresponding strip 470 to electrically connect the pin 452 to the corresponding strip 470. But, in addition or alternatively to using solder, the pin segments 472 may be electrically connected to the corresponding strips 470 using any other arrangement, such as, but not limited to, physical contact, an electrically conductive epoxy, and/or the like.

Figure 8:
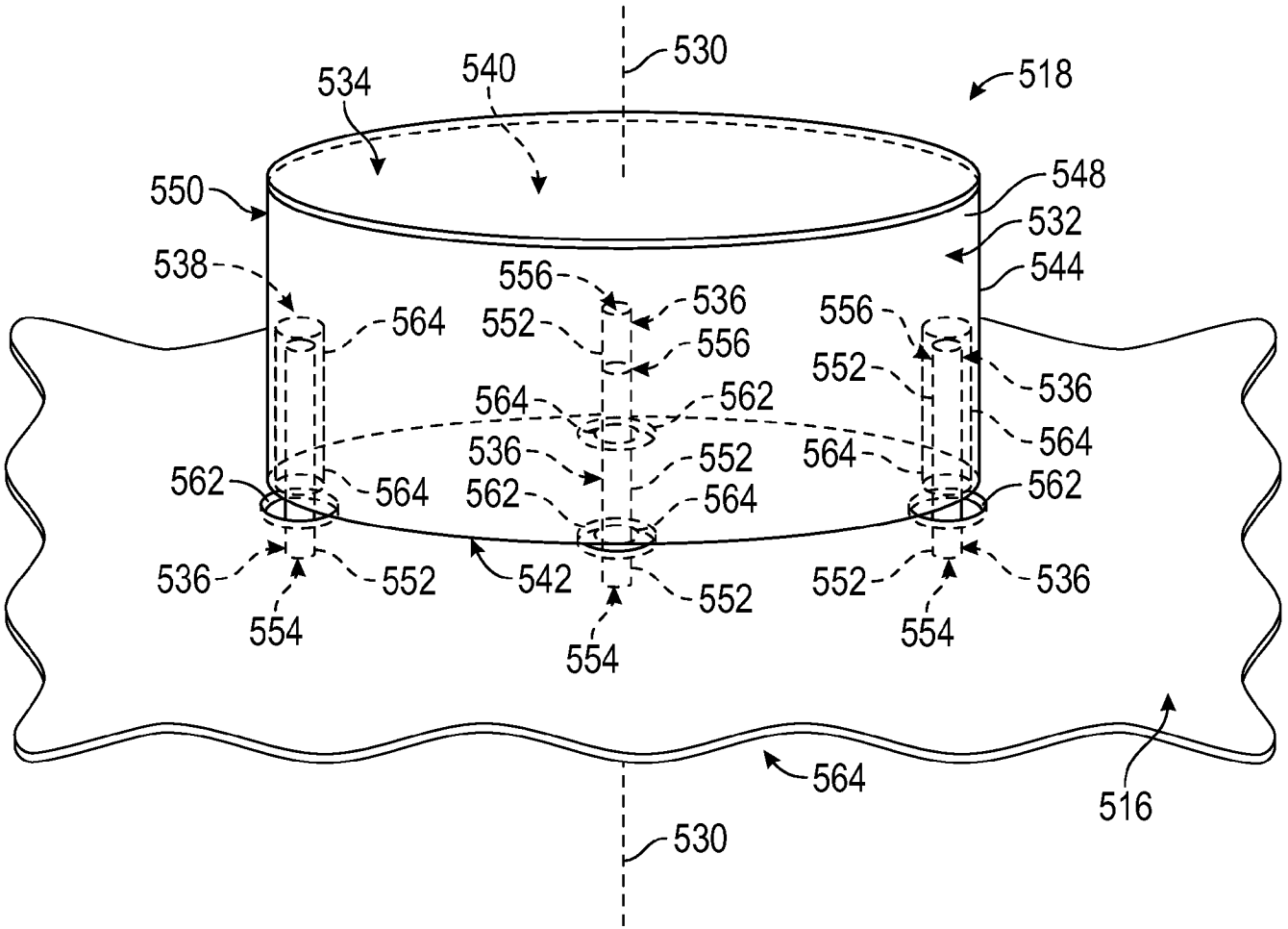
FIG. 8 is a perspective view of yet another exemplary embodiment of a patch antenna.

FIG. 8 is a perspective view of yet another exemplary embodiment of a patch antenna 518 illustrating another exemplary embodiment of an arrangement of the interface between feed probes 536 and a substrate 532 of the patch antenna 518. The patch antenna 518 includes a dielectric substrate 532, a radiating patch 534 positioned on the substrate 532, and a plurality of feed probes 536. The ground plane 516 shown in FIG. 8 may or may not be considered a component of the patch antenna 518.

The substrate 532 of the patch antenna 518 has a body 538 that extends a thickness along a central axis 530 from a side 540 of the substrate body 538 to an opposite side 542 of the substrate body 538. The substrate body 538 includes one or more side walls 544 that extend from the side 540 to the side 542. The side wall 544 of the substrate body 538 has an exterior surface 548 that defines a perimeter 550 of the substrate body 538. The substrate 532 is positioned on the ground plane 516 such that the side 542 of the substrate body 538 is engaged in physical contact with the ground plane 516. The radiating patch 534 is positioned on the side 540 of the substrate body 538 that is opposite the side 542. The side 540 of the substrate body 538 may be referred to herein as a "first" side, while the side 542 may be referred to herein as a "second" side.

The substrate body 538 includes openings 564 that extend into the side 542 of the substrate body 538. The structure of some of the openings 564 is only partially shown in FIG. 8 for clarity. The openings 564 are spaced apart from each other along the perimeter 550 of the substrate body 538, as is shown in FIG. 8. Each opening 564 may extend any depth into the substrate body 538. In the exemplary embodiment of the substrate 532, the openings 564 extend into the substrate body 538 at an approximately parallel angle relative to the central axis 530. But, each opening 564 may extend into the substrate body 538 at any other angle relative to the central axis 530 that enables the corresponding feed probe 536 to function as described and/or illustrated herein, for example an angle that is between approximately 0° and approximately 90° with respect to the central axis 530 or an angle that is between approximately 90° and approximately 180° with respect to the central axis 530.

In the exemplary embodiment of the patch antenna 518, each feed probe 536 includes an approximately straight pin 552 that extends a length from an end 554 to an opposite end 556. Only some of the ends 554 are shown in FIG. 8 for clarity. The end 554 of each pin 552 is electrically connected to the feed network 12 (FIG. 1). In the exemplary embodiment of the feed probes 536, the end 554 of each pin 552 is exposed on a side 564 of the ground plane 516 for electrical connection to the feed network 12.

The pins 552 extend through corresponding thru-opening 562 of the ground plane 516. The structure of some of the openings 562 is only partially shown in FIG. 8 for clarity. The ends 556 of the pins 552 interface with the substrate 532. Specifically, ends 556 of the pins 552 are positioned relative to the substrate body 538 such that adjacent feed probes are spaced apart from each other along the substrate body 538, as can be seen in FIG. 8. The end 556 of each pin 552 is received within a corresponding opening 564 of the substrate body 538. Each pin 552 extends into the corresponding opening 564 such that the end 556 of the pin 552 is received within the opening 564. Accordingly, each pin 552 extends into the substrate body 538 through the side 542 of the substrate body 538. Each pin 552 may extend any depth into the corresponding opening 564. Each pin 552 may be disengaged from physical contact with the substrate body 538 within the corresponding opening 564 or may engage the substrate body 538 within the corresponding opening 564.

The embodiments described and/or illustrated herein may provide a patch antenna that operates over a wider frequency band than at least some known patch antennas. The embodiments described and/or illustrated herein may provide a patch antenna having a frequency band that overlaps the different frequency bands of two or more different GNSS satellite constellations. The embodiments described and/or illustrated herein may provide a patch antenna that is capable of communicating with two or more different GNSS satellite constellations that operate over different frequency bands. The embodiments described and/or illustrated herein may provide a patch antenna that operates in a plurality of different frequency sub-bands of the frequency band of a particular GNSS satellite constellation. In other words, the embodiments described and/or illustrated herein may provide a patch antenna having coverage over multiple frequency bands for a single satellite constellation.

The embodiments described and/or illustrated herein may provide a patch antenna that is smaller than at least some known patch antennas. For example, the embodiments described and/or illustrated herein may provide a patch antenna that includes a smaller width, length, diameter, radius, and/or the like than at least some known patch antennas. The embodiments described and/or illustrated herein may provide an array that is capable of including more patch antennas than at least some known arrays of patch antennas.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A patch antenna comprising:

a dielectric substrate having a body that extends a thickness from a first side to a second side that is opposite the first side, the body of the substrate having a perimeter that is defined by at least one side wall that extends along the thickness of the substrate from the first side to the second side, wherein the body of the substrate has a dielectric constant that is greater than the dielectric constant of air;

a radiating patch positioned on the first side of the body of the substrate;

a ground plane positioned on the second side of the body of the substrate; and at least three feed probes electromagnetically coupled to the radiating patch such that the patch antenna is configured to generate a circularly polarized radiation pattern, wherein the feed probes are positioned relative to the body of the substrate such that adjacent feed probes are spaced apart from each other along the body, the feed probes being configured to feed the radiating patch at at least three points with approximately equal power amplitude, wherein the substrate comprises electrically conductive strips positioned on the at least one side wall of the body, wherein the feed probes comprise approximately straight pins that are positioned around the perimeter of the body of the substrate, wherein the straight pins are electrically connected to the corresponding electrically conductive strips and extend lengths along the thickness of the body.

2. The antenna of claim 1 wherein the patch antenna includes four feed probes, adjacent feed probes being spaced apart from each other along the body of the substrate by approximately 90° along the perimeter, the feed probes being configured to feed the radiating patch with a progressive 90° phase shift.

3. The antenna of claim 1, wherein, the feed probes are soldered to the corresponding electrically conductive strips such that the feed probes are electrically connected to the corresponding electrically conductive strips.

4. The antenna of claim 1, wherein the body of the substrate has a dielectric constant that is greater than approximately 5.0.

5. The antenna of claim 1, wherein the radiating patch is configured to at least one of receive or transmit radio frequency (RF) energy over a bandwidth of at least approximately 100 MHz.

6. The antenna of claim 1, wherein the antenna has a width of less than approximately 2.0 inches (50.8 mm).

7. The antenna of claim 1, further comprising an electrically conductive pin positioned within the body of the substrate.

8. A patch antenna comprising:

a dielectric substrate having a body that extends a thickness from a first side to a second side that is opposite the first side, the body of the substrate having a perimeter that is defined by at least one side wall that extends along the thickness of the substrate from the first side to the second side, wherein the body of the substrate has a dielectric constant that is greater than the dielectric constant of air;

a radiating patch positioned on the first side of the body of the substrate;

a ground plane positioned on the second side of the body of the substrate; and four feed probes electromagnetically coupled to the radiating patch such that the patch antenna is configured to generate a circularly polarized radiation pattern, the feed probes being positioned relative to the body of the substrate such that adjacent feed probes are spaced apart from each other by approximately 90° along the body, the feed probes being configured to feed the radiating patch at four points with approximately equal power amplitude and a progressive 90° phase shift, wherein the substrate comprises electrically conductive strips positioned on the at least one side wall of the body, wherein the feed probes comprise approximately straight pins that are positioned around the perimeter of the body of the substrate, wherein the straight pins are electrically connected to the corresponding electrically conductive strips and extend lengths along the thickness of the body.

9. The antenna of claim 8, wherein the radiating patch is configured to at least one of receive or transmit radio frequency (RF) energy over a bandwidth of at least approximately 400 MHz.

10. The antenna of claim 8, wherein the body of the substrate is fabricated from at least one of ceramic, rubber, fluoropolymer, composite material, fiber-glass, or plastic.

* * * * *